US011988093B2

(12) United States Patent
Wei et al.

(10) Patent No.: US 11,988,093 B2
(45) Date of Patent: May 21, 2024

(54) INFLATABLE FOLDING TUNNEL REINFORCEMENT STRUCTURE AND CONSTRUCTION METHOD THEREOF

(71) Applicant: Hangzhou City University, Hangzhou (CN)

(72) Inventors: Gang Wei, Hangzhou (CN); Tianbao Xu, Hangzhou (CN); Xin Li, Hangzhou (CN); Tianyu Zhu, Hangzhou (CN); Shuangyan Lin, Hangzhou (CN); Luju Liang, Hangzhou (CN); Chengbao Hu, Hangzhou (CN); Xiao Wang, Hangzhou (CN)

(73) Assignee: Hangzhou City University, Hangzhou (CN)

( * ) Notice: Subject to any disclaimer, the term of this patent is extended or adjusted under 35 U.S.C. 154(b) by 0 days.

(21) Appl. No.: 18/259,403

(22) PCT Filed: Jan. 4, 2023

(86) PCT No.: PCT/CN2023/070320

§ 371 (c)(1),
(2) Date: Jun. 27, 2023

(87) PCT Pub. No.: WO2024/040853

PCT Pub. Date: Feb. 29, 2024

(65) Prior Publication Data

US 2024/0076984 A1 Mar. 7, 2024

(30) Foreign Application Priority Data

Aug. 25, 2022 (CN) ..... 202211022632.9

(51) Int. Cl.
*E21D 11/18* (2006.01)
*E21D 11/38* (2006.01)

(52) U.S. Cl.
CPC ..... *E21D 11/183* (2013.01); *E21D 11/381* (2013.01)

(58) Field of Classification Search
CPC ..... E21D 11/183; E21D 11/381
(Continued)

(56) References Cited

U.S. PATENT DOCUMENTS 1,246,134 A * 11/1917 Meem ..... E21D 9/06 405/141
4,437,788 A * 3/1984 Walbröhl ..... E21D 11/102 405/141
10,563,372 B1 2/2020 Huang

FOREIGN PATENT DOCUMENTS

CN 208441863 U 1/2019
CN 110939457 A 3/2020
(Continued)

*Primary Examiner* — Tara Mayo
(74) *Attorney, Agent, or Firm* — Bayramoglu Law Offices LLC

(57) ABSTRACT

An inflatable folding tunnel reinforcement structure and a construction method thereof are provided. The inflatable folding tunnel reinforcement structure includes an inflation port, an airbag, a water blocking net, a steel plate, a scissor folding mechanism, a vertical support plate, an arc-shaped support plate, drainage channels, an upper support rod, a lower support rod, a locking pin, a threaded steel rod, a rolling connection pin, and an induction motor, where the upper support rod and the lower support rod are unfolded in opposite directions to a preset position through the steel rod; and the drainage channels are configured to perform water guidance and resistance for a leakage-proofing purpose. The construction method includes: preparation before construction, device fixation, on-site construction, structural inspection, and site cleaning.

5 Claims, 7 Drawing Sheets

(58) Field of Classification Search
USPC ..... 405/141–142
See application file for complete search history.

(56) References Cited

FOREIGN PATENT DOCUMENTS

| | | | |
|---|---|---|---|
| CN | 113339001 | A | 9/2021 |
| CN | 114370287 | A | 4/2022 |
| CN | 115288726 | A | 11/2022 |
| JP | 2014224421 | A | 12/2014 |
| WO | 2015189537 | A1 | 12/2015 |

* cited by examiner

INFLATABLE FOLDING TUNNEL REINFORCEMENT STRUCTURE AND CONSTRUCTION METHOD THEREOF

CROSS REFERENCE TO THE RELATED APPLICATIONS

This application is the national phase entry of International Application No. PCT/CN2023/070320, filed on Jan. 4, 2023, which is based upon and claims priority to Chinese Patent Application No. 202211022632.9, filed on Aug. 25, 2022, the entire contents of which are incorporated herein by reference.

TECHNICAL FIELD

The present disclosure belongs to the field of tunnel reinforcement, and in particular to an inflatable folding tunnel reinforcement structure and a construction method thereof.

BACKGROUND

In China, with the development of urbanization, population is gathering in cities, leading to a sharp increase in urban population density and a decrease in aboveground space year by year. In this context, urban construction is gradually targeting underground space, and the development of modern rail transit has become a social hotspot. However, with the increase in the number of operating tracks, adverse conditions such as ground loading and unloading of surrounding foundation pits above the subway tunnel are inevitable. As a result, serious problems such as leakage, cracking, peeling and dislocation of segments will arise, bringing huge potential safety hazards to the normal operation of the tunnel.

The existing tunnel reinforcement structures include mounting a steel ring or pasting an aramid fiber cloth on the inner wall of the segment of the tunnel. However, a steel ring mounted in a narrow space cannot achieve sound reinforcement. It also requires an accurate estimation on the linearity, clearance, and cross-sectional diameter of the concrete section before mounting, which is complex to operate. The reinforcement effect of the aramid fiber cloth is greatly affected by the degree of tunnel deformation, and has a high requirement on the tunnel. In addition, these two traditional reinforcement structures cannot effectively treat the leakage hazard of the segment of the tunnel.

Therefore, it is necessary to propose an improved tunnel reinforcement structure and a construction method thereof.

SUMMARY

A major objective of the present disclosure is to provide an inflatable folding tunnel reinforcement structure and a construction method thereof, in order to overcome the shortcomings in the prior art.

To achieve the above objective, the present disclosure adopts the following technical solutions:

An inflatable folding tunnel reinforcement structure includes an inflation port, an airbag, a water blocking net, a steel plate, a scissor folding mechanism, a vertical support plate, an arc-shaped support plate, drainage channels, an upper support rod, a lower support rod, a locking pin, a threaded steel rod, a rolling connection pin, and an induction motor, where from an overall perspective, the inflation port is located at a position close to a bottom at one end of a side of the airbag; the airbag includes an outer surface fixedly connected to the water blocking net and an inner surface adhered to the steel plate; the scissor folding mechanism is provided between the steel plate and the vertical support plate, as well as between the steel plate and the arc-shaped support plate; the scissor folding mechanism is fixedly connected to the steel plate, the vertical support plate, and the arc-shaped support plate through the rolling connection pin; the arc-shaped support plate is located on an upper part of the vertical support plate; and the arc-shaped support plate is fixedly connected to the vertical support plate; and from a detail perspective, the scissor folding mechanism includes the upper support rod, the lower support rod, the locking pin, the threaded steel rod, the rolling connection pin, and the induction motor; the rolling connection pin is configured to fixedly connect the upper support rod and the lower support rod through the locking pin; the threaded steel rod is fixedly connected to the upper support rod and the lower support rod through the locking pin; the induction motor is located at one side of an end of the threaded steel rod, and is fixedly connected to the threaded steel rod; the water blocking net includes the drainage channels; and the drainage channels are located on two sides inside the water blocking net.

Preferably, the scissor folding mechanism is composed of a symmetrical pair of the upper support rod and the lower support rod, and cooperates with the threaded steel rod to achieve simple and efficient support.

Preferably, the drainage channels each are rectangular, and are able to achieve effective water resistance and guidance, so as to achieve a desired leakage-proofing effect.

A construction method of the inflatable folding tunnel reinforcement structure includes the following steps:

S1: preparation before construction: determining, based on a location and severity of a tunnel defect such as peeling and leakage of a segment, a size and quantity of each of the steel plate, the vertical support plate, the arc-shaped support plate, the upper support rod, the lower support rod, and the threaded steel rod, an output power of the induction motor, and a specification of the airbag; and transporting materials and devices to a construction site;

S2: device fixation: erecting the vertical support plate and the arc-shaped support plate on site; assembling the scissor folding mechanism, and fixedly connecting the scissor folding mechanism to the vertical support plate and the arc-shaped support plate; fixedly connecting the steel plate to the scissor folding mechanism; adhering the airbag to the steel plate; and fixedly connecting the water blocking net to the outer surface of the airbag;

S3: establishing a three-dimensional (3D) coordinate system O-XYZ based on an intersection point O between a geometric center of the inflatable folding tunnel reinforcement structure and a ground as an origin, where the 3D coordinate system O-XYZ includes an X-axis direction parallel to a transverse arrangement direction of the vertical support plate, a Y-axis direction parallel to a longitudinal arrangement direction of the vertical support plate, and a Z-axis direction parallel to a central axis of the arc-shaped support plate; an external pressure on each surface of the inflatable folding tunnel reinforcement structure is F; the vertical support plate has a height of $H_1$, and the arc-shaped support plate has a radius of R; the vertical support plate and the arc-shaped support plate each have a thickness of a and a length of b; the steel plate has a density of ρ; the upper support rod of the scissor folding mechanism forms an angle of θ with the threaded steel rod; in the scissor folding mechanism located directly above the arc-shaped support plate, coordinates of two bottom through-holes A and F of the lower support rod are $(0,0,H_1+R)$ and $(0,0,H_1+R)$, respectively, and coordinates of two top through-holes C and D of the upper support rod are $(0,0,H_1+R+2L\sin\theta)$ and $(0,0,H_1+R+2L\sin\theta)$, respectively; coordinates of left and right hinge points B and E of the threaded steel rod are $(0,L\cos\theta,H_1+R+L\sin\theta)$ and $(0,-L\cos\theta,H_1+R+L\sin\theta)$, respectively; and the left hinge point B of the threaded steel rod is moved at a speed of $v_0$ under the action of the induction motor;

S4: calculating a mass of the steel plate as follows:

$$m=\rho V=18b\rho(2aR+a^2);$$

calculating forces exerted on the upper support rod and the lower support rod of the scissor folding mechanism as follows:

$$F_{BC}=F_{ED}=\frac{F+\mathrm{mg}}{2\sin\theta};$$

$$F_{AB}=F_{FE}=\frac{F+\mathrm{mg}}{2\sin\theta};$$

$$F_{BE}=\frac{F+\mathrm{mg}}{\tan\theta};$$

calculating, when θ=90°, a minimum force exerted on the upper support rod and the lower support rod as follows:

$$F_{min}=\frac{F+\mathrm{mg}}{2};$$

calculating the output power of the induction motor to the left and right hinge points B and E of the threaded steel rod as follows:

$$P_B=F_{BE}v_0=\frac{(F+\mathrm{mg})v_0}{\tan\theta};$$

S5: carrying out construction at the construction site, if, based on the external pressure exerted on the scissor folding mechanism and gravity mg of the inflatable folding tunnel reinforcement structure, the induction motor is able to provide a sufficient output power for the scissor folding mechanism;

S6: on-site construction: turning on the induction motor to start working; driving, by the induction motor, the threaded steel rod to rotate clockwise; allowing the upper support rod of the scissor folding mechanism to form an angle of θ with the X-axis direction; unfolding the upper support rod and the lower support rod in opposite directions through the threaded steel rod at a rotational speed of $v_0$; turning off, when an outer wall of the steel plate reaches a preset position, the induction motor to stop working; and inflating the airbag through the inflation port to complete reinforcement;

S7: structural inspection: checking working states of the locking pin and the rolling connection pin in the scissor folding mechanism, as well as drainage performance of the drainage channels in the water blocking net; and S8: site cleaning: cleaning up the construction site after the tunnel defect such as peeling and leakage in the segment is corrected and the segment returns to a normal state; and checking the inflation port, the airbag, the water blocking net, the steel plate, the scissor folding mechanism, the vertical support plate, the arc-shaped support plate, the drainage channel, the upper support rod, the lower support rod, the locking pin, the threaded steel rod, the rolling connection pin, and the induction motor, so as to ensure normal operation of a tunnel.

In an embodiment, step S7 further includes: calculating, based on the 3D coordinate system O-XYZ, the drainage performance of the drainage channels in the water blocking net as follows:

simplifying, for a single drainage channel, the 3D coordinate system O-XYZ to a two-dimensional (2D) coordinate system $XO_1Z$ with $O_1$ as the origin, wherein a projection point of $O_1$ coincides with O; and determining that the drainage channels each have a length of t, a width of m, a height of h, a roughness coefficient of n, and an angle of $\theta_1$ with the X-axis direction, and that there are a total of p drainage channels;

calculating a volume of each of the drainage channels as: V=tbh;

calculating a total volume of the drainage channels as: $V_{total}=Vp=tbhp$; and calculating a flow rate of water in each of the drainage channels per second as:

$$Q=\frac{mhh^{\frac{1}{6}}\sqrt{h\sin\theta_1}}{n}=\frac{mh^{\frac{5}{3}}\sqrt{\sin\theta_1}}{n}.$$

The present disclosure has the following characteristics and beneficial effects.

1. In the present disclosure, the airbag, the water blocking net, the steel plate, the scissor folding mechanism, the vertical support plate, and the arc-shaped support plate are combined to treat various tunnel defects such as peeling and leakage of the segment. The present disclosure achieves a desired treatment effect and efficient and convenient construction.

2. In the present disclosure, the upper support rod, the lower support rod, the locking pin, the threaded steel rod, the rolling connection pin, and the induction motor are coordinated. The expansion size can be automatically adjusted according to the actual situation, with high expansion efficiency. The upper support rod and the lower support rod are engaged with the threaded steel rod in a threaded manner, ensuring high stability. The induction motor is intelligently controlled to improve the efficiency of the overall structure.

3. In the present disclosure, the drainage channels in the water blocking net have the function of water guidance and resistance, achieving a desired leakage-proofing effect.

Figure 1:
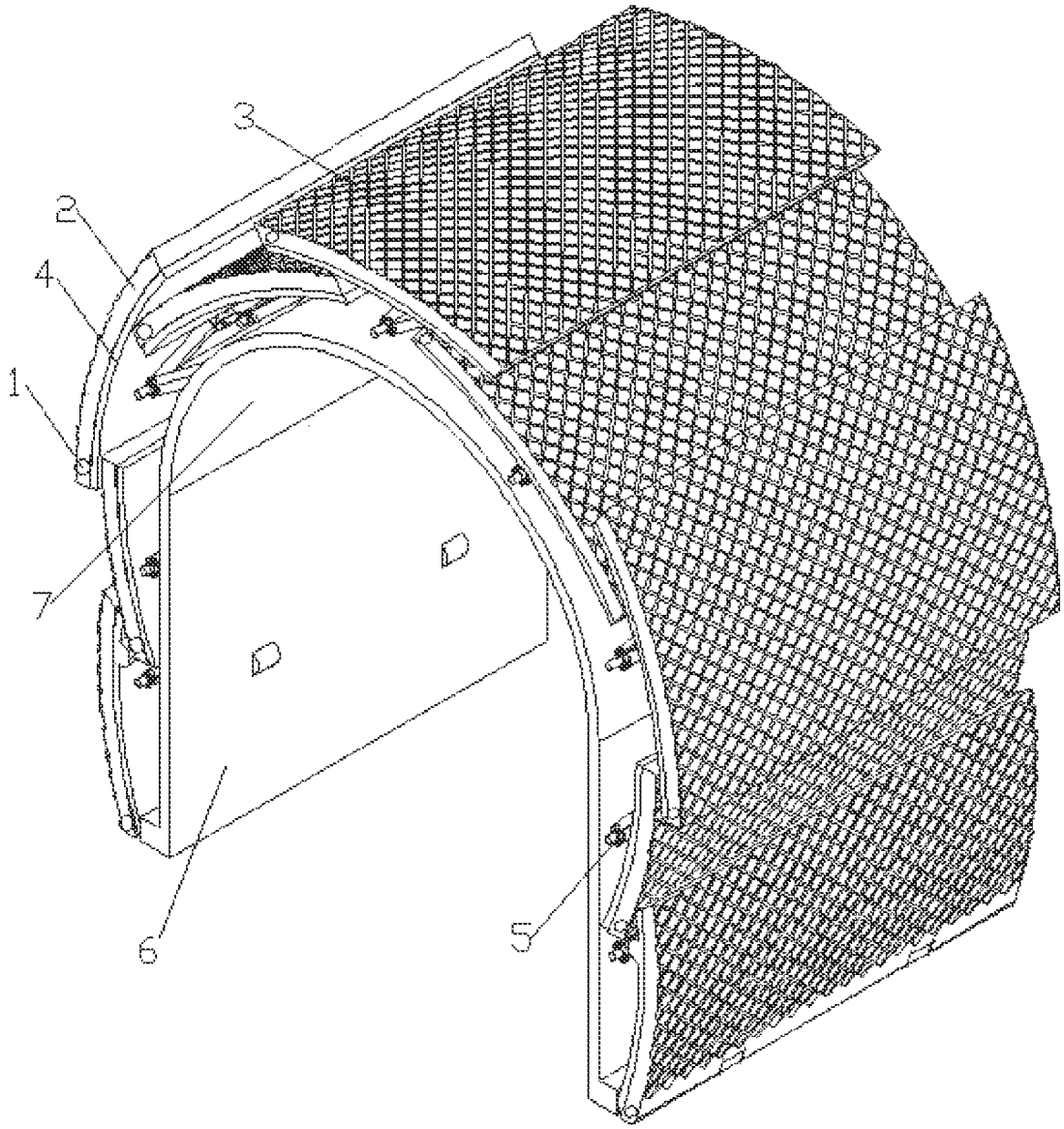
FIG. 1 is a schematic diagram of an inflatable folding tunnel reinforcement structure in an unexpanded state.

Reference Numerals: 1. inflation port; 2. airbag; 3, water blocking net; 4. steel plate; 5. scissor folding mechanism; 6. vertical support plate; 7. arc-shaped support plate; 301. drainage channel; 501. upper support rod; 502. lower support rod; 503. locking pin; 504. threaded steel rod; 505. rolling connection pin; and 506. induction motor.

DETAILED DESCRIPTION OF THE EMBODIMENTS

In order to make the technical means, creative features, objectives, and effects of the present disclosure easily understood, the present disclosure is further described below in combination with the specific implementations.

Embodiment 1

FIG. 1 is a schematic diagram of an inflatable folding tunnel reinforcement structure in an unexpanded state. In the figure, scissor folding mechanisms 5 are in a folded state, $\theta=0$. Inflation port 1 is located at a position close to a bottom at one end of a side of airbag 2. The airbag 2 includes an outer surface fixedly connected to water blocking net 3 and an inner surface adhered to steel plate 4. The scissor folding mechanisms 5 are arranged between the steel plate 4 and vertical support plate 6, as well as between the steel plate and arc-shaped support plate 7. The scissor folding mechanism 5 is fixedly connected to the steel plate 4, the vertical support plate 6, and the arc-shaped support plate 7 through rolling connection pin 505. The arc-shaped support plate 7 is located on an upper part of the vertical support plate 6, and the arc-shaped support plate 7 is fixedly connected to the vertical support plate 6.

Figure 2:
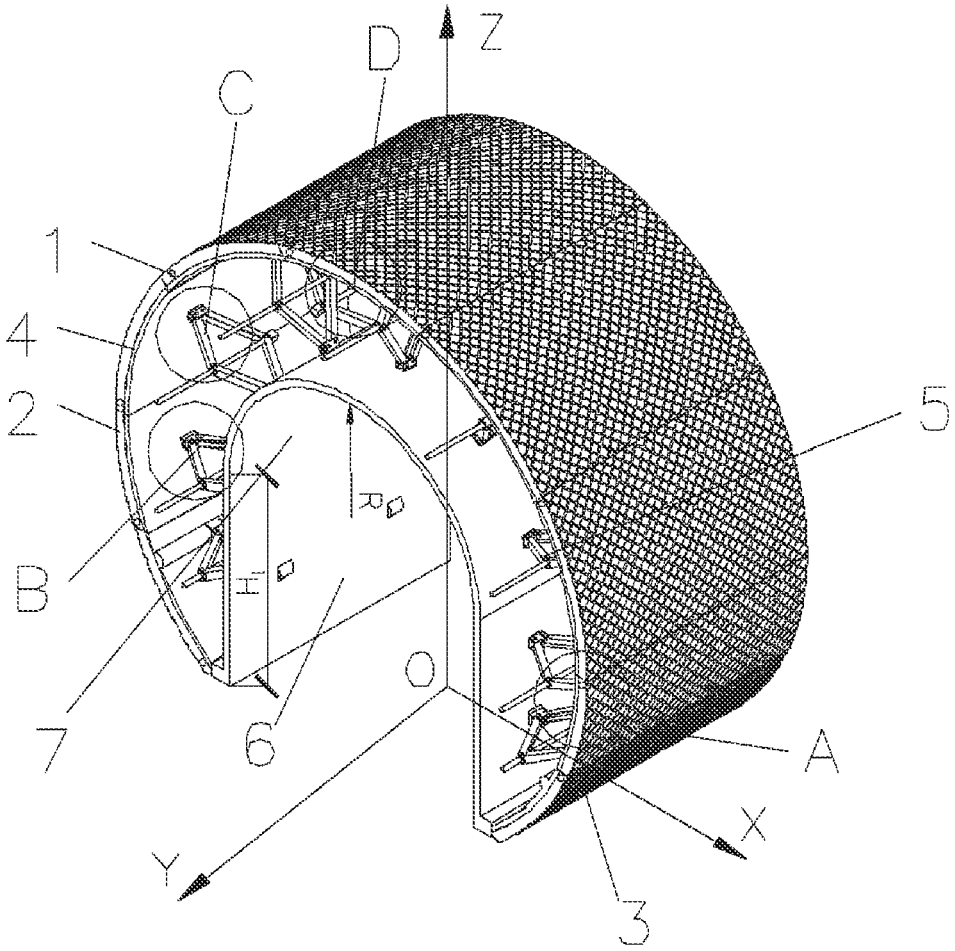
FIG. 2 is a schematic diagram of the inflatable folding tunnel reinforcement structure in an expanded state.
Figure 3:
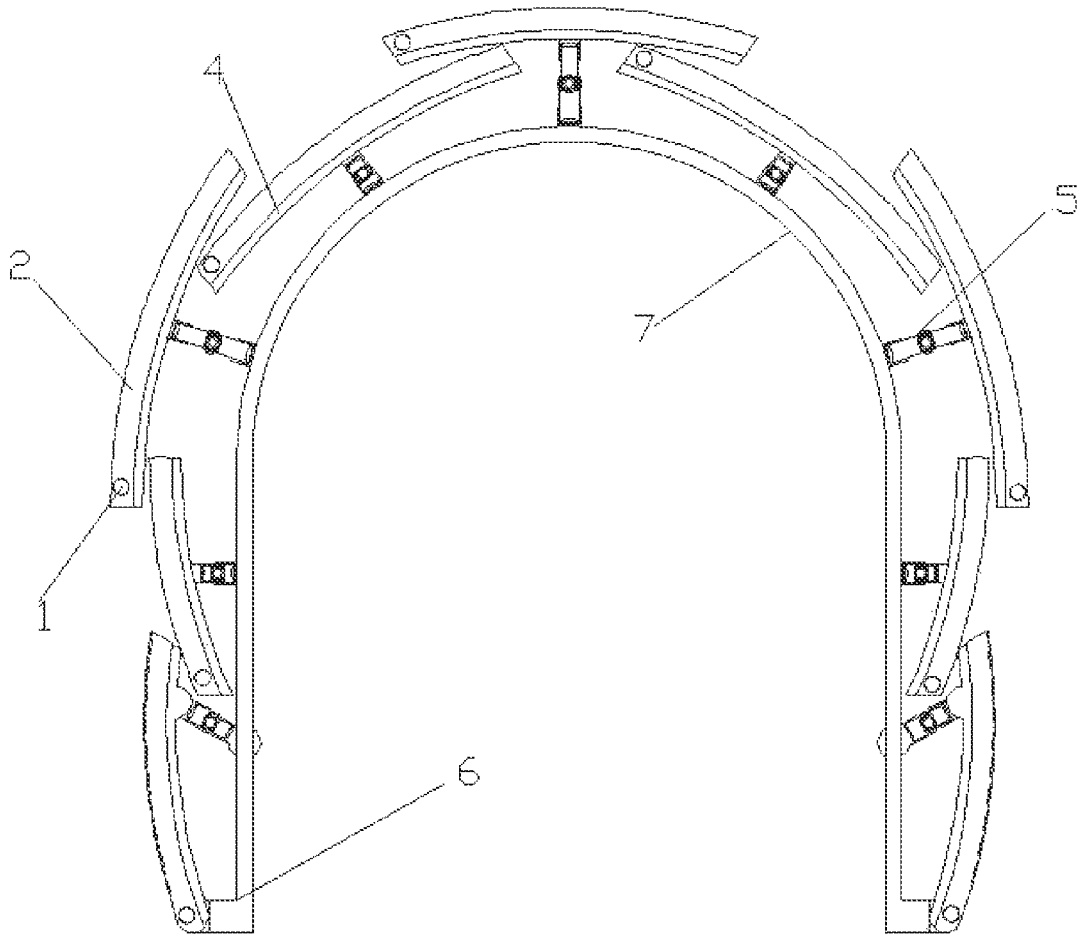
FIG. 3 is a cross-sectional view of the inflatable folding tunnel reinforcement structure in the unexpanded state.
Figure 4:
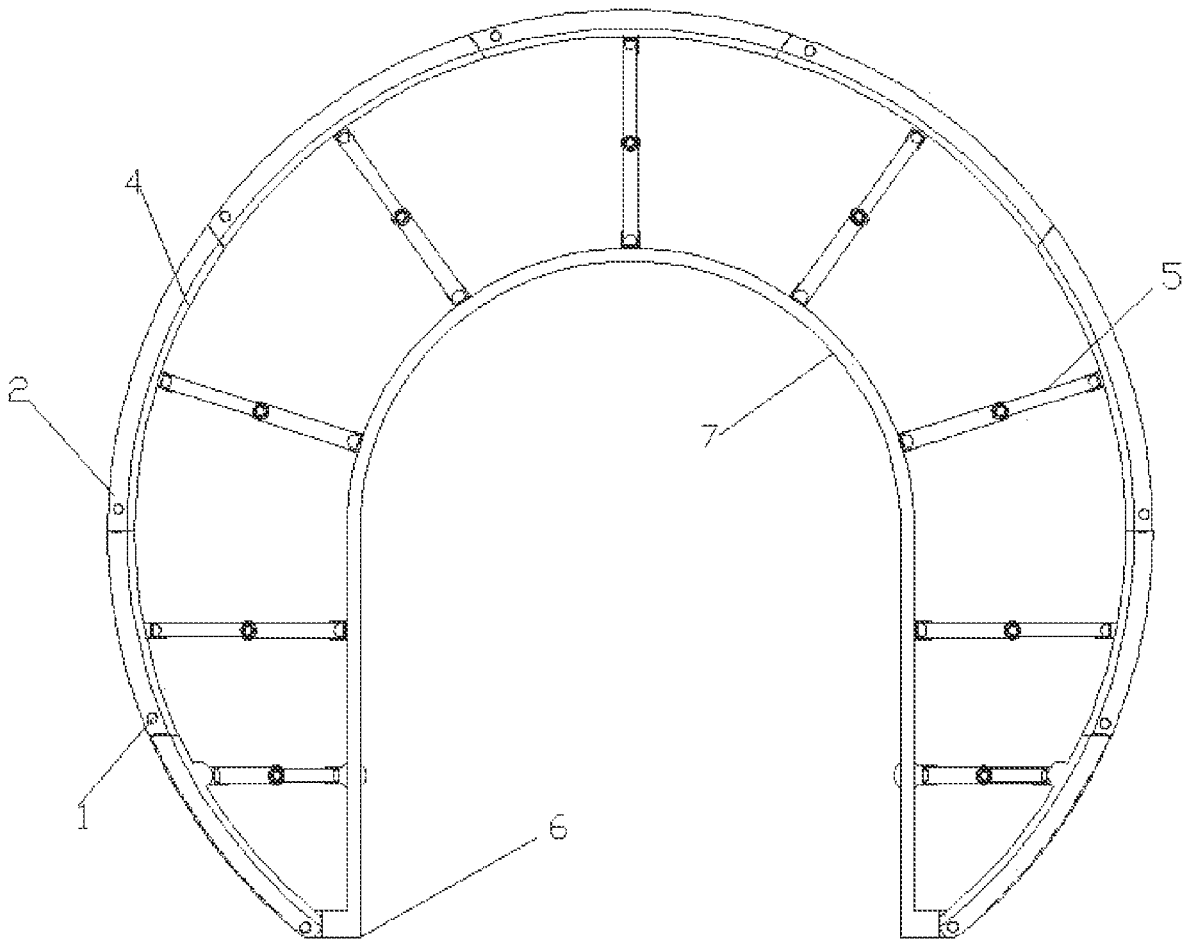
FIG. 4 is a cross-sectional view of the inflatable folding tunnel reinforcement structure in the expanded state.

FIGS. 2 to 4 are a schematic diagram of the inflatable folding tunnel reinforcement structure in an expanded state, a cross-sectional view of the inflatable folding tunnel reinforcement structure in the unexpanded state, and a cross-sectional view of the inflatable folding tunnel reinforcement structure in the expanded state, respectively. The scissor folding mechanism 5 changes from the folded state to an unfolded state. In this case, $\theta$ increases, and an upper support rod and a lower support rod are unfolded in opposite directions through a threaded steel rod at a rotational speed of $v_0$, Through the scissor folding mechanism 5, the steel plates 4 are spliced from a staggered shape to an arc shape.

Figure 5:
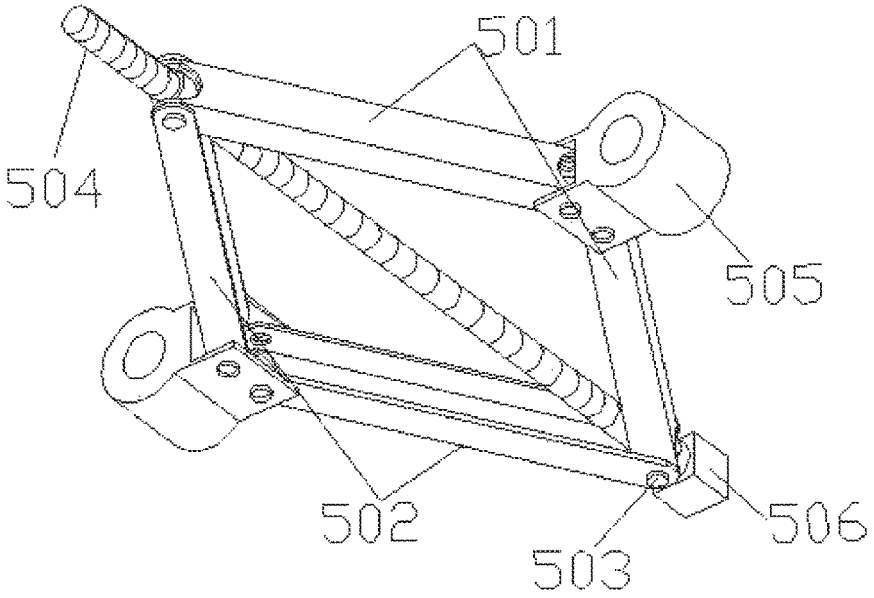
FIG. 5 is a schematic diagram of a scissor folding mechanism.

FIG. 5 is a schematic diagram of the scissor folding mechanism 5. The scissor folding mechanism includes the upper support rod 501, the lower support rod 502, locking pin 503, the threaded steel rod 504, the rolling connection pin 505, and induction motor 506. The rolling connection pin 505 is configured to fixedly connect the upper support rod 501 and the lower support rod 502 through the locking pin 503. The threaded steel rod 504 is fixedly connected to the upper support rod 501 and the lower support rod 502 through the locking pin 503. The induction motor 506 is located at one side of an end of the threaded steel rod 504, and is fixedly connected to the threaded steel rod 504.

Figure 6:
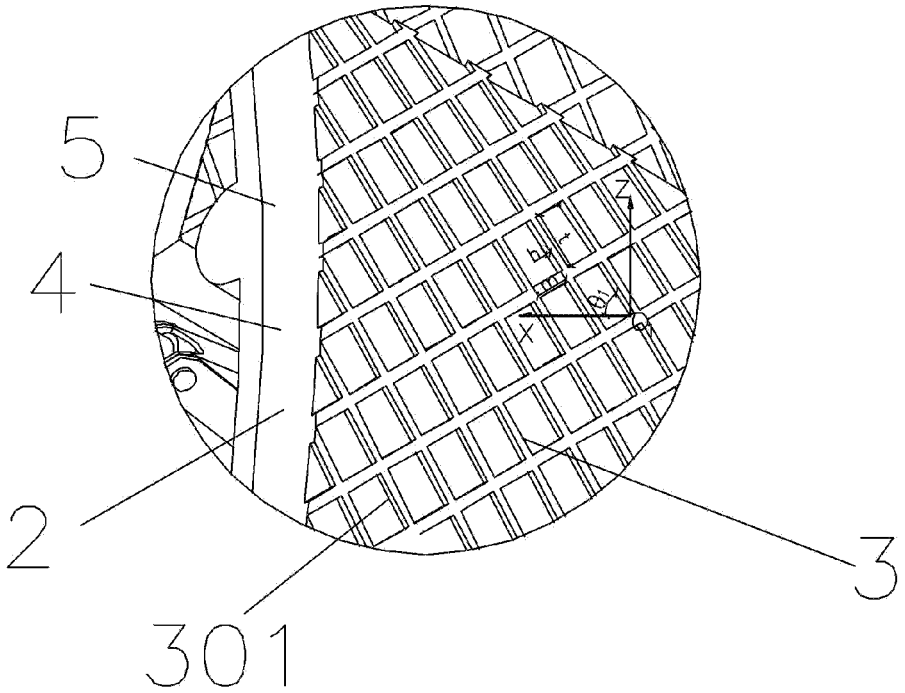
FIG. 6 is an enlarged view of a point A of the inflatable folding tunnel reinforcement structure in the expanded state.

FIG. 6 is an enlarged view of point A of the inflatable folding tunnel reinforcement structure in the expanded state. The water blocking net 3 is provided with drainage channels 301. The drainage channels 301 each are rectangular, with length t, width m, height h, angle $\theta_1$ with an X-axis, and roughness coefficient n. The drainage channels 301 are located on two sides inside the water blocking net 3.

Figure 7:
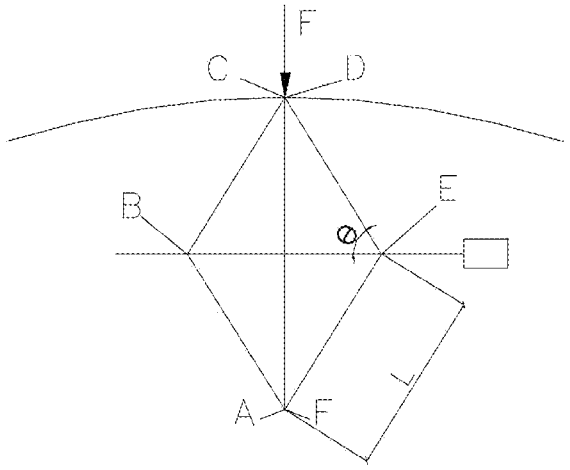
FIG. 7 is an enlarged view of a point B of the inflatable folding tunnel reinforcement structure in the expanded state.

FIG. 7 is an enlarged view of point B of the inflatable folding tunnel reinforcement structure in the expanded state. In the scissor folding mechanism 5, each rod has length L. The upper support rod 501 forms angle $\theta$ with the threaded steel rod 504. The steel plate 4 connected to the upper support rod 501 is subjected to a force of F perpendicular to a surface of the steel plate. In the scissor folding mechanism 5, a distance between through-holes at hinge points A and F, as well as between through-holes at hinge points C and D, is ignored.

Figure 8:
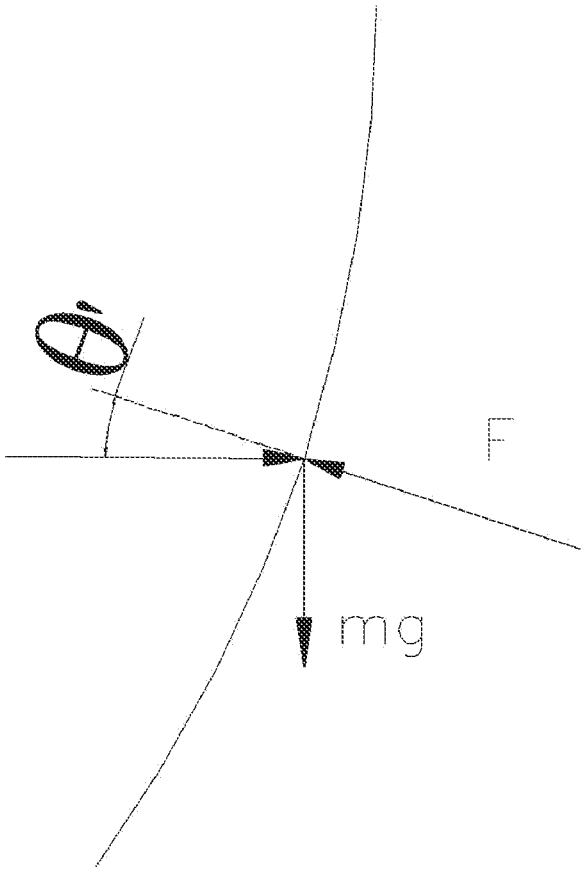
FIG. 8 is an enlarged view of a point C of the inflatable folding tunnel reinforcement structure in the expanded state.

FIG. 8 is an enlarged view of point C of the inflatable folding tunnel reinforcement structure in the expanded state. In the scissor folding mechanism 5, each rod is subjected to vertical downward gravity mg of the inflatable folding tunnel reinforcement structure and the force F exerted on the surface of the steel plate 4. The threaded steel rod 504 forms angle $\theta'$ with F.

Figure 9:
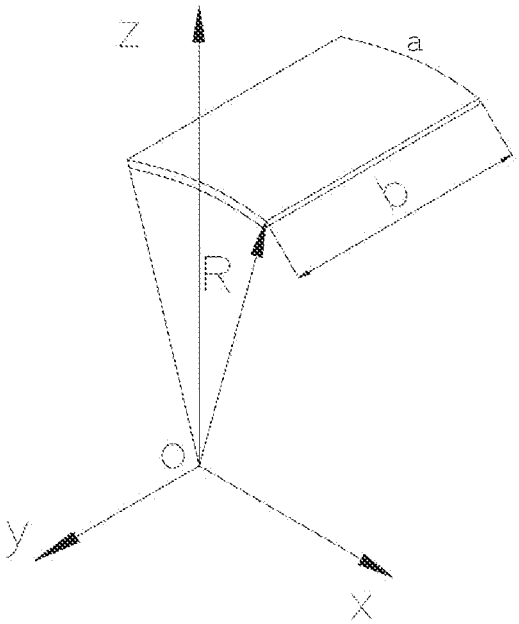
FIG. 9 is an enlarged view of point D of the inflatable folding tunnel reinforcement structure in the expanded state.

FIG. 9 is an enlarged view of point D of the inflatable folding tunnel reinforcement structure in the expanded state. The arc-shaped support plate 7 has radius R, thickness a, and length b.

Embodiment 2

In a specific implementation, each ring of a tunnel with a diameter of 7.7 m includes one 20° segment, two 68.75° segments, and three 67.5° segments. Each of the segments has a length of 2 m and a thickness of 0.3 m. During operation, a large amount of load is generated on an upper part of a water-rich section of the tunnel due to the construction of a new building, resulting in defects such as concrete peeling and leakage of the segments.

The specific construction steps are as follows.

S1. Preparation before construction. Based on the location and severity of peeling and leakage of the segment, materials are selected, including the steel plate 4, the vertical support plate 6, the arc-shaped support plate 7, the upper support rod 501, the lower support rod 502, the threaded steel rod 504, the induction motor 506, and the airbag 2. Specifically, there are 9 curved steel plates 4, each with an arc length of 2.4 m, a length of 2.5 m, and a thickness of 0.015 m. There are two vertical support plates, each with a length of 2.5 m, a width of 3.5 m, and a thickness of 0.05 m. A bottom corner of the vertical support plate is 2.5 m long, 0.15 m wide, and 0.05 m thick. There is one arc-shaped support plate with an arc length of 5.65 m, a length of 2.5 in, and a thickness of 0.05 m. There are 36 upper support rods, each with a length 2.3 in, a width of 0.05 m, and a height of 0.05 m, and 36 lower support rods, each with a length of 2.3 m, a width of 0.05 m, and a height of 0.05 m. There are 18 threaded steel rods, each with a diameter of 0.05 m and a length of 1 m. The induction motor has a power of 80 kW. The expansion specifications of the airbag include an arc length of 2.4 m, a length of 2.5 m, and a thickness of 0.05 m. The materials and devices are transported to a construction site.

S2. Device fixation. The vertical support plates 6 and the arc-shaped support plate 7 are erected on site. The scissor folding mechanisms 5 are assembled. Each of the scissor folding mechanisms 5 is fixedly connected to two upper support rods 501 and two lower support rods 502. After assembly, the scissor folding mechanisms 5 are fixedly connected to the vertical support plates 6 and the arc-shaped support plate 7. The steel plates 4 are fixedly connected to the scissor folding mechanisms 5. Each of the steel plates 4 is fixedly connected to two scissor folding mechanisms 5. The airbags 2 are adhered to the steel plates 4. The water blocking net 3 is fixedly connected to the outer surface of the airbag 2.

S3. Three-dimensional (3D) coordinate system O-XYZ is established based on geometric center O of the inflatable folding tunnel reinforcement structure as an origin. The 3D coordinate system O-XYZ includes an X-axis direction parallel to a transverse arrangement direction of the vertical support plate 6, a Y-axis direction parallel to a longitudinal arrangement direction of the vertical support plate 6, and a Z-axis direction parallel to a central axis of the arc-shaped support plate 7. An external pressure on each surface of the inflatable folding tunnel reinforcement structure is F. The vertical support plate 6 has height $H_1$, and the arc-shaped support plate 7 has radius R. The vertical support plate 6 and the arc-shaped support plate 7 have thickness a and length b. The steel plate 4 has density ρ. The upper support rod 501 of the scissor folding mechanism 5 forms angle θ with the threaded steel rod 504. In the scissor folding mechanism 5 located directly above the arc-shaped support plate 7, coordinates of two bottom through-holes A and F of the lower support rod 502 are $(0,0,H_1+R)$ and $(0,0,H_1+R)$, respectively, and coordinates of two top through-holes C and D of the upper support rod 501 are $(0,0,H_1+R+2L\sin\theta)$ and $(0,0,H_1+R+2L\sin\theta)$, respectively. Coordinates of left and right hinge points B and E of the threaded steel rod (504) are $(0,L\cos\theta,H_1+R+L\sin\theta)$ and $(0,-L\cos\theta,H_1+R+L\sin\theta)$, respectively. The left hinge point B of the threaded steel rod 504 is moved at a speed of $v_0$ under the action of the induction motor 506.

Specifically, as shown in FIGS. 2, 7, and 9, the vertical support plate 6 and the arc-shaped support plate 7 have a thickness of a=0.05 m and a length of b=2.5 m, the steel plate 4 has a density of ρ=7.8 kg/m, the upper support rod 501 of the scissor folding mechanism 5 forms an angle of θ=0-90° with the threaded steel rod 504.

S4. A mass of the steel plate is calculated as follows:

$$m=\rho V=18b\rho(2aR+a^2).$$

The forces exerted on the upper support rod 501 and the lower support rod 502 of the scissor folding mechanism 5 are calculated as follows:

$$F_{BC}=F_{ED}=\frac{F+\mathrm{mg}}{2\sin\theta};$$

$$F_{AB}=F_{FE}=\frac{F+\mathrm{mg}}{2\sin\theta};$$

$$F_{BE}=\frac{F+\mathrm{mg}}{\tan\theta}.$$

When θ=90°, a minimum force exerted on each rod is:

$$F_{min}=\frac{F+\mathrm{mg}}{2}.$$

The output power of the induction motor 506 to the left and right hinge points B and E of the threaded steel rod 504 is calculated as follows:

$$P_B=F_{BE}V_0=\frac{(F+\mathrm{mg})v_0}{\tan\theta}.$$

Specifically, as shown in FIGS. 7 to 9, in the scissor folding mechanism 5, the angle between the upper support rod 501 and the threaded steel rod 504 is specifically, 0≤θ≤90°. When θ=90°, the entire inflatable folding tunnel reinforcement structure is the safest.

S5. Based on the external pressure F exerted on the scissor folding mechanism 5 and the gravity mg of the inflatable folding tunnel reinforcement structure, if the induction motor 506 can provide a sufficient output power for the scissor folding mechanism 5, construction can be carried out at the construction site.

S6. On-site construction. The induction motor 506 with a power of 80 kW is turned on to start working. The induction motor 506 drives the threaded steel rod 504 to rotate clockwise. The upper support rod 501 of the scissor folding mechanism 5 forms an angle of θ with the X-axis direction. The upper support rod 501 and the lower support rod 502 are unfolded in opposite directions through the threaded steel rod 504 at a rotational speed of $v_0$. When an outer wall of the steel plate 4 reaches a preset position, the induction motor 506 is turned off to stop working. The airbag 2 is inflated through the inflation port 1 to complete reinforcement.

S7. Structural inspection. The working states of the locking pin 503 and the rolling connection pin 505 in the scissor folding mechanism 5, as well as the drainage performance of the drainage channels 301 in the water blocking net 3, are checked.

Specifically, based on the 3D coordinate system O-XYZ, the drainage performance of the drainage channels 301 in the water blocking net 3 is calculated as follows.

For a single drainage channel, the 3D coordinate system O-XYZ is simplified to a two-dimensional (2D) coordinate system $XO_1Z$ with $O_1$ as the origin. A projection point of $O_1$ coincides with that of O, so it is determined that the drainage channel 301 has length t, width m, height h, roughness coefficient n, and forms an angle of $\theta_1$ with the X-axis direction. There are a total of p drainage channels 301.

A volume of each of the drainage channels 301 is: V=tbh.

A total volume of the drainage channels 301 is: $V_{total}$=Vp=tbhp.

A flow rate of water in the drainage channel 301 in one second is:

$$Q=\frac{mhh^{\frac{1}{6}}\sqrt{h\sin\theta_1}}{n}=\frac{mh^{\frac{5}{3}}\sqrt{\sin\theta_1}}{n}.$$

S8. Site cleaning. After the tunnel defect such as peeling and leakage in the segment is corrected and the segment returns to a normal state, the site is cleaned up. Again, the inflation port 1, the airbag 2, the water blocking net 3, the steel plate 4, the scissor folding mechanism 5, the vertical support plate 6, the arc-shaped support plate 7, the drainage channel 301, the upper support rod 501, the lower support rod 502, the locking pin 503, the threaded steel rod 504, the rolling connection pin 505, and the induction motor 506 are checked, so as to ensure normal operation of a tunnel.

The above described are the basic principles, main features, and advantages of the present disclosure. it should be understood by those skilled in the art that, the present disclosure is not limited by the above embodiments, and the above embodiments and the description only illustrate the principle of the present disclosure. Various changes and modifications may be made to the present disclosure without departing from the spirit and scope of the present disclosure, and such changes and modifications all fall within the claimed scope of the present disclosure. The claimed protection scope of the present disclosure is defined by the appended claims and equivalents thereof.

What is claimed is:

1. An inflatable folding tunnel reinforcement structure, comprising an inflation port, an airbag, a water blocking net, a steel plate, a scissor folding mechanism, a vertical support plate, an arc-shaped support plate, drainage channels, an upper support rod, a lower support rod, a locking pin, a threaded steel rod, a rolling connection pin, and an induction motor, wherein from an overall perspective, the inflation port is located at a position adjacent to a bottom at one end of a side of the airbag; the airbag comprises an outer surface fixedly connected to the water blocking net and an inner surface adhered to the steel plate; the scissor folding mechanism is provided between the steel plate and the vertical support plate, as well as between the steel plate and the arc-shaped support plate; the scissor folding mechanism is fixedly connected to the steel plate, the vertical support plate, and the arc-shaped support plate through the rolling connection pin; the arc-shaped support plate is located on an upper part of the vertical support plate; and the arc-shaped support plate is fixedly connected to the vertical support plate; and from a detail perspective, the scissor folding mechanism comprises the upper support rod, the lower support rod, the locking pin, the threaded steel rod, the rolling connection pin, and the induction motor; the rolling connection pin is configured to fixedly connect the upper support rod and the lower support rod through the locking pin; the threaded steel rod is fixedly connected to the upper support rod and the lower support rod through the locking pin; the induction motor is located at one side of an end of the threaded steel rod, and the induction motor is fixedly connected to the threaded steel rod; the water blocking net comprises the drainage channels; and the drainage channels are located on two sides inside the water blocking net.

2. The inflatable folding tunnel reinforcement structure according to claim 1, wherein the scissor folding mechanism comprises a symmetrical pair of the upper support rod and the lower support rod, and cooperates with the threaded steel rod to achieve simple and efficient support.

3. The inflatable folding tunnel reinforcement structure according to claim 1, wherein the drainage channels each are rectangular, and are configured to achieve effective water resistance and guidance, so as to achieve a desired leakage-proofing effect.

4. A construction method of an inflatable folding tunnel reinforcement structure, comprising the following steps:

S1: preparation before construction: determining, based on a location and severity of a tunnel defect, a size and a quantity of each of a steel plate, a vertical support plate, an arc-shaped support plate, an upper support rod, a lower support rod, and a threaded steel rod, an output power of an induction motor, and a specification of an airbag; and transporting materials and devices to a construction site;

S2: device fixation: erecting the vertical support plate and the arc-shaped support plate on site; assembling a scissor folding mechanism, and fixedly connecting the scissor folding mechanism to the vertical support plate and the arc-shaped support plate; fixedly connecting the steel plate to the scissor folding mechanism; adhering the airbag to the steel plate; and fixedly connecting a water blocking net to an outer surface of the airbag;

S3: establishing a three-dimensional (3D) coordinate system O-XYZ based on an intersection point O between a geometric center of the inflatable folding tunnel reinforcement structure and a ground as an origin, wherein the 3D coordinate system O-XYZ comprises an X-axis direction parallel to a transverse arrangement direction of the vertical support plate, a Y-axis direction parallel to a longitudinal arrangement direction of the vertical support plate, and a Z-axis direction parallel to a central axis of the arc-shaped support plate; an external pressure on each surface of the inflatable folding tunnel reinforcement structure is F; the vertical support plate has a height of $H_1$, and the arc-shaped support plate has a radius of R; the vertical support plate and the arc-shaped support plate each have a thickness of a and a length of b; the steel plate has a density of ρ; the upper support rod of the scissor folding mechanism forms an angle of θ with the threaded steel rod; in the scissor folding mechanism located directly above the arc-shaped support plate, coordinates of two bottom through-holes A and F of the lower support rod are $(0,0,H_1+R)$ and $(0,0,H_1+R)$, respectively, and coordinates of two top through-holes C and D of the upper support rod are $(0,0,H_1+R+2L\sin\theta)$ and $(0,0,H_1+R+2L\sin\theta)$, respectively; coordinates of left and right hinge points B and E of the threaded steel rod are $(0,L\cos\theta,H_1+R+L\sin\theta)$ and $(0,-L\cos\theta,H_1+R+L\sin\theta)$, respectively; and the left hinge point B of the threaded steel rod is moved at a speed of $v_0$ under an action of the induction motor;

S4: calculating a mass of the steel plate as follows:

$$m=\rho V=18b\rho(2aR+a^2);$$

calculating forces exerted on the upper support rod and the lower support rod of the scissor folding mechanism as follows:

$$F_{BC}=F_{ED}=\frac{F+mg}{2\sin\theta};$$

$$F_{AB}=F_{FE}=\frac{F+mg}{2\sin\theta};$$

$$F_{BE}=\frac{F+mg}{\tan\theta};$$

where g is the gravitational constant;

calculating, when θ=90°, a minimum force exerted on the upper support rod and the lower support rod as follows:

$$F_{min}=\frac{F+mg}{2};$$

calculating the output power $P_B$ of the induction motor to the left and right hinge points B and E of the threaded steel rod as follows:

$$P_B = F_{BE}v_0 = \frac{(F + \mathrm{mg})v_0}{\tan\theta};$$

S5: carrying out a construction at the construction site, if, based on the external pressure F exerted on the scissor folding mechanism and a gravity mg of the inflatable folding tunnel reinforcement structure, the induction motor is configured to provide a sufficient output power for the scissor folding mechanism;

S6: on-site construction: turning on the induction motor to start working; driving, by the induction motor, the threaded steel rod to rotate clockwise; allowing the upper support rod of the scissor folding mechanism to form an angle of θ with the X-axis direction; unfolding the upper support rod and the lower support rod in opposite directions through the threaded steel rod at a rotational speed of $v_0$; turning off, when an outer wall of the steel plate reaches a preset position, the induction motor to stop working; and inflating the airbag through an inflation port to complete a reinforcement;

S7: structural inspection: checking working states of a locking pin and a rolling connection pin in the scissor folding mechanism, as well as drainage performance of drainage channels in the water blocking net; and S8: site cleaning: cleaning up the construction site after the tunnel defect such as peeling and leakage in the segment is corrected and the segment returns to a normal state; and checking the inflation port, the airbag, the water blocking net, the steel plate, the scissor folding mechanism, the vertical support plate, the arc-shaped support plate, the drainage channels, the upper support rod, the lower support rod, the locking pin, the threaded steel rod, the rolling connection pin, and the induction motor, so as to ensure a normal operation of a tunnel.

5. The construction method of the inflatable folding tunnel reinforcement structure according to claim 4, wherein step S7 further comprises: calculating, based on the 3D coordinate system O-XYZ, the drainage performance of the drainage channels in the water blocking net as follows:

simplifying, for a single drainage channel, the 3D coordinate system O-XYZ to a two-dimensional (2D) coordinate system $XO_1Z$ with $O_1$ as the origin, wherein a projection point of $O_1$ coincides with O; and determining that the drainage channels each have a length of t, a width of m, a height of h, a roughness coefficient of n, and an angle of $\theta_1$ with the X-axis direction, and that there are a total of p drainage channels;

calculating a volume of each of the drainage channels as: V=tbh;

calculating a total volume of the drainage channels as: $V_{total}$=Vp=tbhp; and calculating a flow rate Q of water in each of the drainage channels per second as:

$$Q = \frac{mhh^{\frac{1}{6}}\sqrt{h\sin\theta_1}}{n} = \frac{mh^{\frac{5}{3}}\sqrt{\sin\theta_1}}{n}.$$

* * * * *